US005090276A

United States Patent [19]

Groskey

[11] Patent Number: 5,090,276

[45] Date of Patent: Feb. 25, 1992

[54] WRENCH FOR INSTALLING STRAINER BASE IN SINK

[76] Inventor: Richard E. Groskey, 2465 Stone St., Oviedo, Fla. 32765

[21] Appl. No.: 701,791

[22] Filed: May 17, 1991

[51] Int. Cl.[5] ..... B25B 13/48

[52] U.S. Cl. ..... 81/436; 81/176.15

[58] Field of Search ..... 81/436, 488, 176.1, 81/176.15; 29/272, 282, 240

[56] References Cited

U.S. PATENT DOCUMENTS

| | | | |
|---|---|---|---|
| 660,829 | 10/1900 | Angell | 81/436 X |
| 1,467,936 | 9/1923 | Janssen | 81/176.15 X |
| 1,793,477 | 2/1931 | German et al. | 81/436 X |
| 2,522,038 | 9/1950 | Houghton | 81/176.15 |
| 2,678,578 | 5/1954 | Bonanno | 81/436 |
| 4,878,406 | 11/1989 | Simpson et al. | 81/436 |

FOREIGN PATENT DOCUMENTS

| | | | |
|---|---|---|---|
| 485203 | 4/1938 | United Kingdom | 81/176.15 |

*Primary Examiner*—D. S. Meislin
*Attorney, Agent, or Firm*—Julian C. Renfro

[57] ABSTRACT

A wrench to be used in engaging opposed notches in a threaded strainer base, to enable the strainer base to be installed in the operative position in the drain of a sink. Such a strainer base has an upper flange, a tapered throat portion, and a lower flange, with the notches being disposed in diametrically opposed locations in the lower flange. This novel wrench comprises a handle, an elongate shaft mounted on the handle, and an elongate drive bar of generally rectangular configuration mounted at right angles to the shaft at a location remote from the handle. The drive bar is dimensioned to fit entirely through the throat of the sink base and to reside in a position in which each end of the drive bar engages one of the opposed notches. Importantly, I utilize a depth-limiting device on the wrench, for engaging the throat of the strainer base, for preventing the ends of the drive bar from passing beyond the notches and into an ineffectual lower position. The handle of the wrench, when the ends of the drive bar are engaging the notches of the strainer base, enabling the strainer base to be turned in rotation in either direction.

17 Claims, 2 Drawing Sheets

WRENCH FOR INSTALLING STRAINER BASE IN SINK

BACKGROUND OF THE INVENTION

It is well known that sinks intended for installation in homes, apartments and restaurants are shipped without any drain fittings or faucets mounted thereon, so it is necessary for the plumber to install components associated with the drain as well as the faucets upon such sinks before they can be put into use.

At the bottom central portion of the sink, a drain hole is provided to receive the drain connection, with this being a circular hole typically configured to receive a sink strainer therein. It is well known that the drain connection involves components to be installed both above and below the sink, with these components including a strainer base equipped with exterior threads that is inserted from above into the drain hole, and a trap member utilized below the drain hole. The trap member is internally threaded to receive the threads of the strainer base. Leakage is prevented by the utilization of one or more ring shaped washers that are disposed between the interfitted members and the sink.

One type of strainer base commonly utilized in industrial sinks is ring shaped, having an upper flange and a lower flange that are interconnected by a throat portion. A strainer base as provided by Franklin Machine Products of Marlton, New Jersey, for example, is approximately 4⅜ inches in diameter and is to be received in a threaded trap opening slightly over 3 inches in diameter.

A pair of oppositely-disposed slots are provided in the lower flange, which slots are intended to be used by the plumber at the time the strainer base is to be installed in an interfitting relationship with the sink trap member. Although a gasket member is utilized between the underside of the upper flange of the strainer base and the portion of the sink surrounding the drain hole, it is nevertheless important for the plumber to tighten the strainer base tightly enough into the trap member as to prevent undesired leakage at the juncture between the sink and components.

Unfortunately, vendors of popularly used strainer bases do not usually provide an installation tool to be used by the plumber at the time the strainer base is to be installed, so most plumbers find themselves resorting to a rather primitive practice, which is to install the strainer base by hand as tightly as possible, and to then utilize a hammer and screwdriver, or other hand-driven means, to complete the tightening process.

In accordance with one aforementioned procedure used in lieu of a suitable tool, the screwdriver is inserted into the sink drain at a decided angle, with the tip of the screwdriver in one of the notches located in the lowermost flange of the strainer base. The upper part of the handle of the screwdriver is then struck one or more times with the hammer, so as to cause the tip of the screwdriver to bring about rotation of the strainer base for a number of degrees in the drain hole of the sink. In doing so, the external threads of the strainer base engage the internal threads of the trap with ever-increasing tightness, until the components have been interfitted and torqued in such a manner as to prevent leakage.

The tightening of the strainer base by repeatedly striking one or both of the notches in the lower flange by the use of a screwdriver and hammer requires a considerable amount of skill if significant damage to the components is to be avoided, and despite careful efforts, may be necessary to secure a replacement for the originally-provided strainer base because of unacceptable damage inflicted to the device during such an installation procedure.

It is the purpose of this invention to improve to a considerable extent over the practices of the prior art by providing a highly effective one-piece hand-operated tool of low cost, by the use of which the strainer base can be readily installed, without damage, in the drain hole of the sink.

SUMMARY OF THE INVENTION

It has been explained hereinabove that up until the present time, no suitable wrench has been provided for engaging opposed notches located in a lower flange of the strainer base. Accordingly, it has been accepted practice for the plumber to place the strainer base in the drain of the sink, with the exterior threads on the strainer base engaging the threads inside the trap located below the sink. The plumber then ordinarily resorts to the practice of utilizing a long screwdriver and a hammer, or other such means, in order to bring about sufficient rotation of the strainer base that the washer located under the upper flange can closely engage the drain of the sink.

This procedure is inexact and time consuming, but most significantly, the screwdriver tip or other torquing medium often causes a severe deformation of the strainer base in the location adjacent the notches, and this frequently results in a strainer base that is scarred or disfigured, thus providing less than satisfactory performance.

Accordingly, I have provided a wrench to be used in engaging opposed notches in a threaded strainer base, to enable the strainer base to be readily installed in the operative position in the drain of a sink. As previously mentioned, such a strainer base has an upper flange, a tapered throat portion, and a lower flange, with the notches being disposed in diametrically opposed locations in the lower flange.

My novel wrench comprises a handle, an elongate shaft mounted at right angles to the handle, and a drive bar of generally rectangular configuration mounted at right angles to the shaft. A plane, if passed through the handle in a perpendicular relationship to the shaft, is essentially parallel to a plane passing through the drive bar in a perpendicular relationship to the shaft. The drive bar is dimensioned to fit through the throat of the sink base and to reside in a position in which each end of the drive bar resides in one of the opposed notches. It is important to note that a depth limiting means arranged to engage the throat of the strainer base is utilized for preventing the ends of the drive bar from passing beyond the notches into an ineffectual lower position.

The handle of my novel wrench, when the ends of the drive bar are positioned to engage the notches of the strainer base, enables the strainer base to be turned in rotation in a highly effective and non-damaging manner, either in the installation direction, which is clockwise, or in the removal direction, which is counterclockwise.

It is accordingly an object of this present invention to provide an inexpensive wrench for use in installing a strainer base in a sink, with the design being such that installation can be accomplished in an expeditious manner even by a relatively unskilled person, without risking damage to any of the components used in the sink, strainer, gasket or trap assembly.

It is another object of my invention to provide a low cost yet highly effective wrench having a drive bar designed to engage the opposed notches located in the lower portion of a strainer base, such that a turning motion can be transmitted in either rotative direction to the strainer base without causing any damage or distortion to the notches.

It is still another object to provide a wrench for use by a plumber or the like, which requires no particular experience for its use, and which does not necessitate the user having to establish the proper position of the drive bar of the wrench by "feel."

It is yet another object of this invention to provide a wrench equipped with an elongate drive bar simultaneously engaging the opposed notches in a strainer base, and utilizing depth limiting means for preventing the drive bar from moving into an ineffective relationship with respect to the notches.

It is yet still another object of this invention to provide a highly effective one-piece wrench by which a positive locking engagement of a sink strainer member can be readily brought about.

These and other objects, features and advantages will be more apparent from a study of the appended drawings.

DETAILED DESCRIPTION

Figure 1:
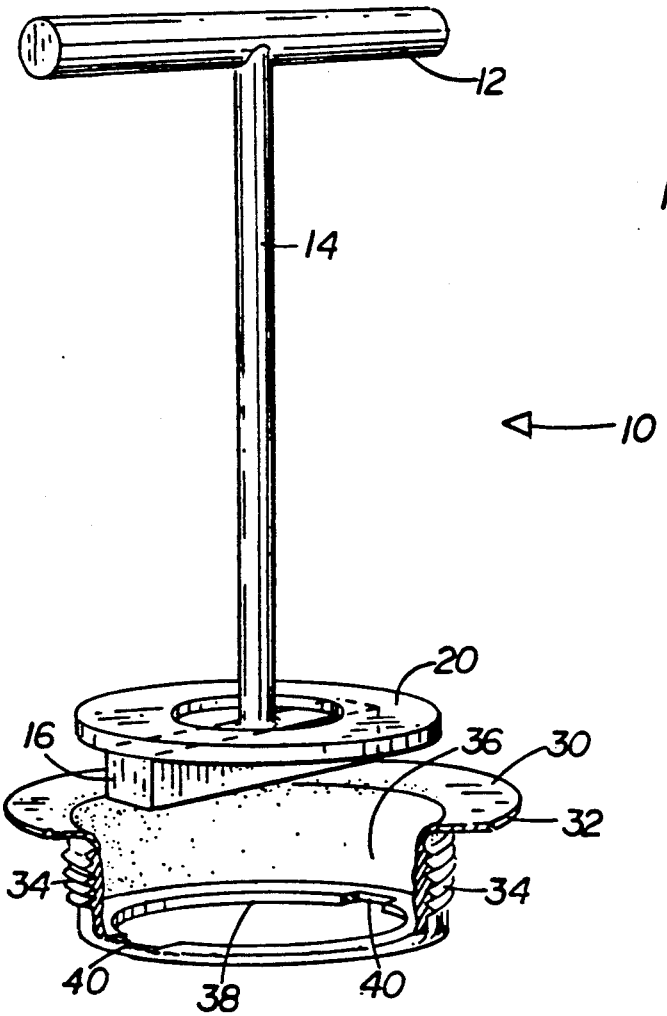
FIG. 1 is a perspective view of a preferred embodiment of a wrench in accordance with this invention, showing the lower portion of the wrench located adjacent the opposed notches in the strainer base that is to be installed in the drain of a sink.

With initial reference to FIG. 1 it can there be seen that I have provided a perspective view of a wrench 10 in accordance with this invention, which has a handle 12, and an elongate shaft 14, with the handle and shaft residing in a "T" shaped relationship. Of significance to this invention is the mounting of a drive bar 16 on the end of the shaft remote from the handle. All of the components of my novel wrench are typically made of steel, and the handle 12 and the drive bar 16 are normally welded to the shaft 14, but this is not a firm requirement.

Secured to the upper surface of the drive bar 16 is a depth limiting device 20, which may be circular, although I am not to be limited to this configuration. For example, the device 20 could be a multi-sided device, such as square, hexagonal or octagonal, or could even be made up of a plurality of spoke-like members of similar length.

I may also call the device 20 a penetration determining means, and as will be seen hereinafter, the device 20 enables even a relatively unskilled user to either install a strainer base in a sink, by a clockwise rotation, or else remove the strainer base therefrom, by a counterclockwise rotation.

Shown directly below the drive bar 16 of the wrench in FIG. 1 is a strainer base 30 of the type that is to be installed in the drain of a sink, typically a sink of the type utilized in restaurants and the like. The strainer base 30 is generally ring shaped, having an upper, outwardly turned flange 32, external threads 34, a throat 36, and a lower, inwardly turned flange 38. A flat strainer may be utilized in an essentially co-planar relationship with the upper flange 32, and in addition, the lower, inwardly turned flange 38 may be used for supporting a strainer basket, but the use of both of these strainer type devices is optional with the user.

A pair of notches 40 are utilized in the inwardly turned flange 38 for the plumber to utilize in installing the strainer base in a sink. The external threads 34 provided around the exterior of the throat portion of the strainer base are designed to engage threads located in the interior of the trap of the sink, as will be discussed shortly.

One trap for a sink with which my wrench may be used is marketed by Franklin Machine Products of Marlton, New Jersey, who provide one model of sink trap that utilizes a ring shaped strainer base having an overall diameter of approximately 4⅜ inches, with the external threads of the strainer base being approximately 3 5/16 inches in diameter. The lower flange 38 of the strainer base sold by Franklin has an inner diameter of approximately 2⅞ inches, with the flat portions of the opposed notches being approximately 3⅛ inches apart. The Franklin traps can have outlets of 1½ inches, 2 inches and 3 inches, and a single size strainer base is not usable with all three sizes. Therefore, it is obvious that the flat portions of the opposed notches may vary slightly from the above-stated dimension.

Of consequence to the design of the instant wrench is the placement by the manufacturer of the aforementioned opposed pair of notches 40 in the lower flange 38, which notches are to be used in bringing about the rotation of the strainer base at such time as it is being installed in the drain opening of a sink 48. As will be discussed in conjunction with later figures, the drive bar or driving lug 16 is dimensioned so that it can be brought into effective contact with the opposed notches 40 at the time the strainer base is to be turned in rotation.

The drive bar 16 may be regarded as being in the configuration of a rectangular solid, being several times as long as it is wide, with the bottom of the handle 14 being attached to the middle of the drive bar. The drive bar 16 is typically square in cross section, with the ends of the drive bar being sized to engage both of the notches 40 at the same time. For use with the above-mentioned size of strainer base or trap support provided by Franklin Machine Products, the overall length of the driving lug would be slightly under 3⅛ inches, which will easily fit through the throat portion of the strainer base, which may be on the order of 3¼ inches in diameter. Quite obviously, I am not to be limited to this length of lug. I may also refer to the component 16 as a notch-engaging member.

It is to be understood that my novel wrench is not limited for use with this size sink trap provided by Franklin Machine Products, or even to a sink trap sold by Franklin, for it is obvious that the active components of my wrench can be manufactured in a size for effective use with strainer bases made by other manufacturers.

Figure 2:
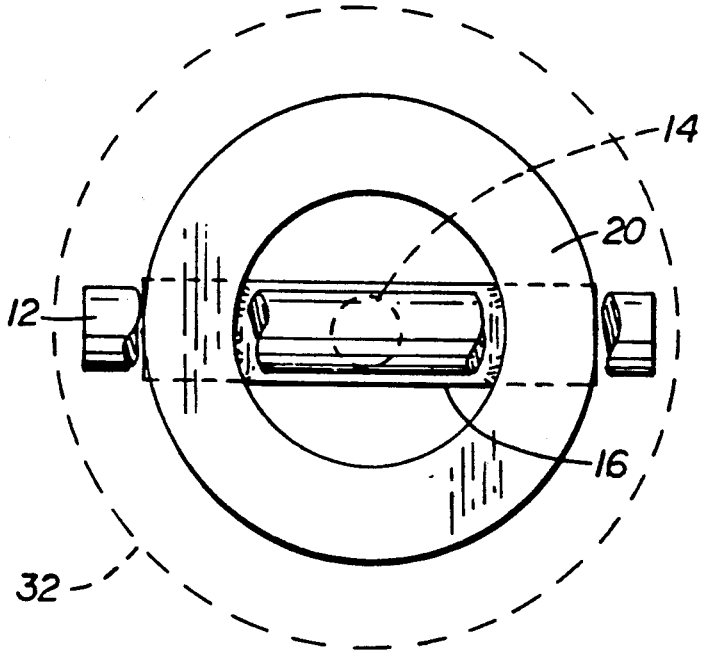
FIG. 2 is a view from above, looking directly down into the drain of a sink, with my tool in place therein.

FIG. 2 reveals that the handle 12 is preferably located in the same plane as the drive bar 16, although this clearly is not a rigid requirement of this invention, for the handle and the drive bar could be disposed in entirely different planes. Since it is not a requirement for the handle and the drive bar to be co-planar, I preferably describe my wrench as having a handle portion as well as a drive bar portion that are each perpendicular to the elongate shaft 14, with the further stipulation that planes perpendicular to the shaft that pass through the handle and through the drive bar are generally parallel to each other.

Figure 3:
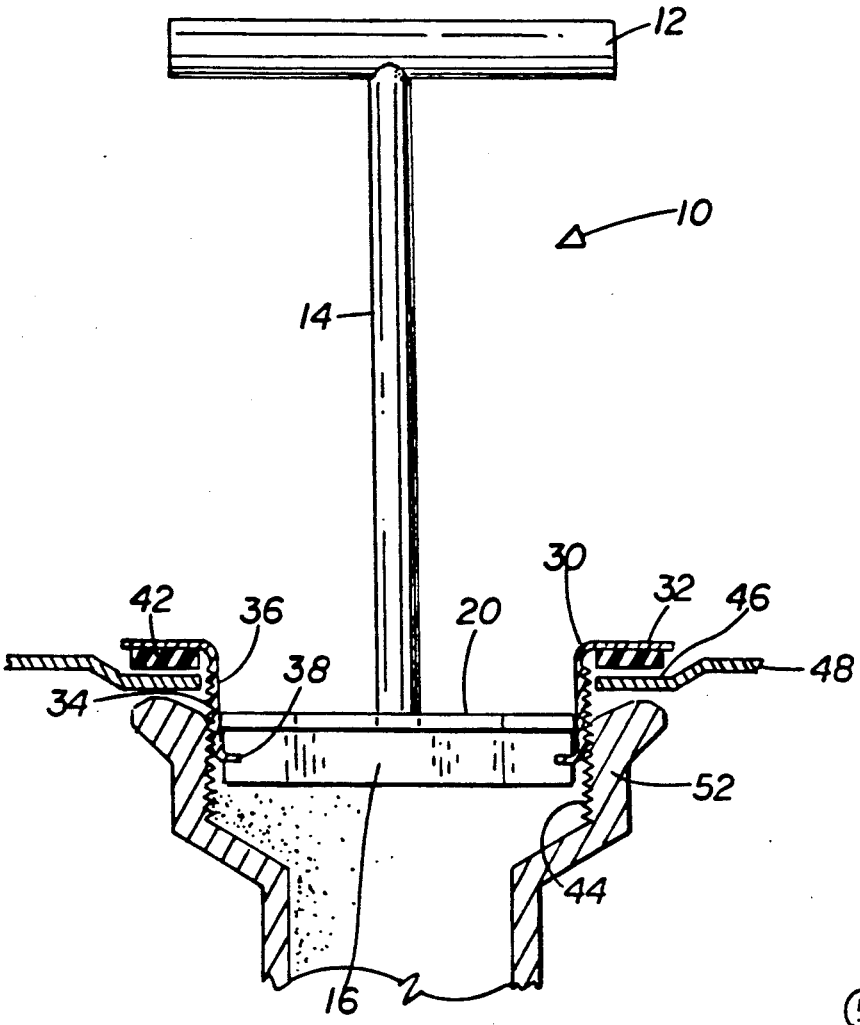
FIG. 3 is a side elevational view in which the strainer base and sink trap are shown in section to illustrate how the components are interfitted, with this view revealing the drive bar located between the notches provided in the lower flange.

It is to be seen from FIG. 3 that the elongate drive bar 16 is dimensioned lengthwise so as to pass through the throat 36 and to assume a position in which each end of the drive bar 16 resides in one of the opposed notches 40 in the lower flange 38. It is important to note that I utilize depth limiting means 20 on the wrench 10, for engaging the throat 36 of the strainer base, so as to prevent the ends of the drive bar 16 from passing on through the notches and into an ineffectual lower position. As is obvious, the handle 12 of the wrench, when the ends of the drive bar 16 are effectively engaging the notches 40 of the strainer base, enables the strainer base 30 to be turned in rotation until such time as the underside of the upper flange 32 has been brought into firm contact with a gasket or suitable sealing material, and the circular edge 46 of the hole in the sink.

With continuing reference to FIG. 3, it is to be noted that either a ring shaped washer 42, or a suitable sealant, such as plumber's dope, is provided on the underside of the upper, outwardly turned flange 32, which washer is to be brought into sealing contact with the upper edge 46 of the circular hole in the sink 48. This sealing contact of the washer 42 with the underside of the upper flange 32 and the upper edge 46 of the circular hole in the sink 48 is brought about by the threads 34 on the exterior of the strainer base 30 being in engagement with the interior threads 44 of the trap 52, and the user then causing the strainer base to rotate for the proper number of turns by the use of my novel wrench.

Figure 4:
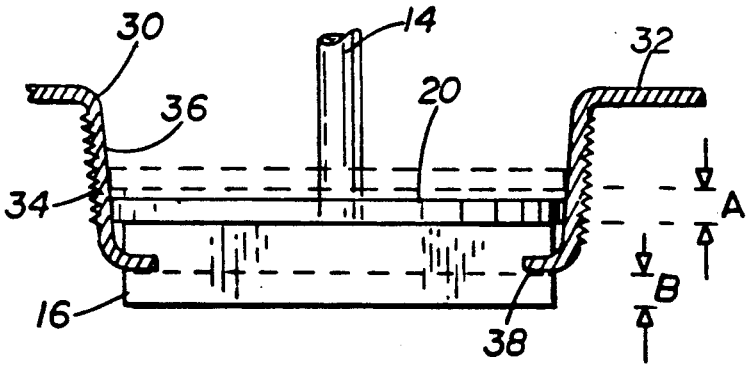
FIG. 4 is a fragmentary view to a somewhat larger scale than in FIG. 3, illustrating how the novel depth limiting means is provided adjacent a lower portion of the wrench in order to prevent the drive bar of the wrench from passing beyond and through the notches and into an ineffectual position.

FIG. 4 reveals to a somewhat larger scale, the drive bar or driving lug 16 having passed through the throat 36 of the strainer base 30, and into a position in which it resides between the notches 40 that the manufacturer has provided in the lower, inwardly turned flange 38. It is important to note that the manufacturer of the strainer base provides no bottom or restraint of any kind associated with the notches 40, so it is easily possible for the drive bar or driving lug to pass through the notches, and into an ineffective position below the notches. It is for this reason that I utilize the depth limiting device or penetration determining means 20 on the lower part of the wrench 10, closely adjacent the drive bar 16. Because of the utilization of the depth limiting device, the user of my wrench does not need to resort to "feel" when endeavoring to have the ends of the drive bar properly engage the notches for the purpose of the application of torque thereto.

It is important to note that the depth limiting device 20 is dimensioned so as to permit it to enter the upper part of the throat 36, but to come to rest in a mid portion of the throat. I configure the depth limiting device or penetration determining means to reach its lowermost position in the throat 36 at such time as the mid portion of the drive bar 16 is located between the notches, so that the user can expect the strainer base to be driven in rotation at such time as torque is applied to the handle 12. Because of this advantageous construction, it is not necessary, as previously mentioned, for the user to depend upon skill or "feel" in placing the drive bar 16 in an operative relationship with the notches 40.

I am aware of the fact that there can be a considerable amount of variation in the diameter of the throat 36, such that the depth limiting device 20 can come to rest in any one of a range of positions indicated at "A" in FIG. 4. The depth limiting device in accordance with this invention is typically disposed closely adjacent the drive bar, so it is to be understood that the drive bar could come to rest between the notches 40 in a range of vertical positions indicated at "B" in FIG. 4. However, I carefully size the depth limiting device 20 for the mid-range of throat sizes, so that my wrench can continue to properly function with a very high percentage of the strainer bases that will be produced by a given manufacturer, despite the expected wear of his forming dies and manufacturing procedures.

Figure 5:
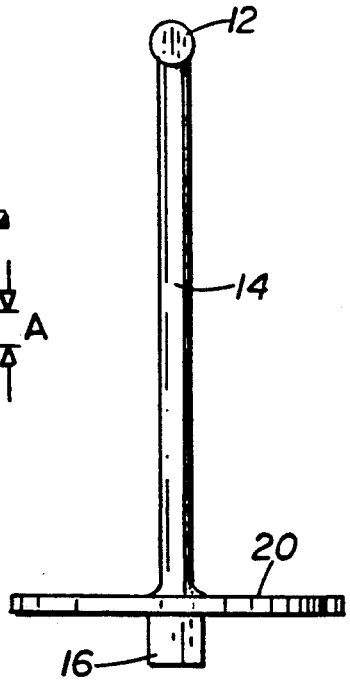
FIG. 5 is a side elevational view of the instant wrench, showing that the handle is normally in the same plane as the drive bar.

Although I prefer to use a circular depth limiting device 20 that is secured to the top of the drive bar 16, it is obvious that the depth limiting device could be a configuration other than circular, as long as it utilizes components to properly engage the inner sidewalls of the throat of the strainer base. Also, the depth limiting device could be configured to fit closely around the shaft 14, and to be welded to the base of the shaft, as indicated in FIG. 5.

My novel wrench is typically made of steel, but it is to be understood that I am not to be limited to any particular material as long as such material is sufficiently rigid. In some instances, a non-ferric metal could be used in the manufacture of my wrench, or my wrench may be constructed out of certain industrial plastics.

I claim:

1. A wrench to be used in engaging opposed notches in a threaded strainer base, to enable the strainer base to be installed in the operative position in the drain of a sink, the strainer base having an upper flange, a tapered throat portion, and a lower flange, with the notches being disposed in diametrically opposed locations in the lower flange, said wrench comprising a handle, an elongated shaft mounted on said handle, and an elongate drive bar of generally rectangular configuration mounted at a location remote from said handle, said drive bar extending outwardly well beyond said shaft at right angles thereto, and being several times as long as it is wide, said drive bar nevertheless being dimensioned to fit entirely through the throat of the sink base and to reside in a position in which each end of said drive bar engages one of the opposed notches, and depth limiting means on said wrench for engaging the throat of the strainer base, for preventing the ends of said drive bar from passing beyond the notches into an ineffectual position, said handle of said wrench, when the ends of said drive bar are engaging the notches of the strainer base, enabling the strainer base to be turned in rotation in either direction.

2. The wrench as recited in claim 1 in which said depth limiting means for engaging the throat of the strainer base is a member rigidly attached to said drive bar, said member being dimensioned to come firmly to rest in the throat of the strainer base at such time as the ends of said drive bar are residing in operative contact with the notches of the strainer base.

3. The wrench as recited in claim 1 in which said depth limiting means for engaging the throat of the strainer base is a member rigidly attached to said shaft, said member being dimensioned to come firmly to rest in the throat of the strainer base at such time as the ends of said drive bar are residing in operative contact with the notches of the strainer base.

4. The wrench as recited in claim 1 in which said depth limiting means for engaging the throat of the strainer base is circularly shaped.

5. The wrench as recited in claim 1 in which said depth limiting means for engaging the throat of the strainer base is multi-sided.

6. The wrench as recited in claim 1 in which said handle forms a T-shaped relationship to said shaft.

7. A wrench to be used in engaging opposed notches in a threaded strainer base, to enable the strainer base to be installed in the operative position in the drain of a sink, the strainer base having an upper flange, a tapered throat portion, and a lower flange, with the notches being disposed in diametrically opposed locations in the lower flange, said wrench comprising a handle, an elongate shaft mounted at right angles to said handle to form a T-shaped relationship, and an elongate drive bar of generally rectangular configuration mounted upon said shaft at a location remote from said handle, said drive bar extending outwardly well beyond said shaft, at right angles thereto, and being several times as long as it is wide, said drive bar nevertheless being dimensioned to fit entirely through the throat of the sink base and to reside in a position in which each end of said drive bar engages one of the opposed notches, and depth limiting means on said wrench for engaging the throat of the strainer base, for preventing the ends of said drive bar from passing beyond the notches into an ineffectual position, said handle of said wrench, when the ends of said drive bar are engaging the notches of the strainer base, enabling the strainer base to be turned in rotation.

8. The wrench as recited in claim 7 in which said depth limiting means for engaging the throat of the strainer base is a member rigidly attached to said drive bar, said member being dimensioned to come firmly to rest in the throat of the strainer base at such time as the ends of said drive bar are residing in operative contact with the notches of the strainer base.

9. The wrench as recited in claim 7 in which said depth limiting means for engaging the throat of the strainer base is a member rigidly attached to said shaft, said member being dimensioned to come firmly to rest in the throat of the strainer base at such time as the ends of said drive bar are residing in operative contact with the notches of the strainer base.

10. The wrench as recited in claim 7 in which said depth limiting means for engaging the throat of the strainer base is circularly shaped.

11. The wrench as recited in claim 7 in which said depth limiting means for engaging the throat of the strainer base is multi-sided.

12. A wrench to be used in engaging opposed notches in a threaded strainer base, to enable the strainer base to be installed in the operative position in the drain of a sink, the strainer base having an upper flange, a tapered throat portion, and a lower flange, with the notches being disposed in diametrically opposed locations in the lower flange, said wrench comprising an elongate shaft having a handle at one end and an elongate drive bar mounted on the other end, with said handle and said drive bar being spaced a number of inches apart, said handle being mounted at right angles to said elongate shaft, said drive bar extending outwardly at right angles from both sides of said shaft, and being in the configuration of a rectangular solid several times as long as it is wide, said drive bar nevertheless being dimensioned to fit entirely through the throat of the sink base and to reside in a position in which each end of said drive bar engages one of the opposed notches, and depth limiting means operatively disposed at a location closely adjacent said drive bar, said depth limiting means preventing the ends of said drive bar from passing beyond the notches into an ineffectual position, said handle of said wrench, when the ends of said drive bar are engaging the notches of the strainer base, enabling the strainer base to be turned in rotation.

13. The wrench as recited in claim 12 in which said depth limiting means is a member rigidly attached to said drive bar, said member being dimensioned to come firmly to rest in the throat of the strainer base at such time as the ends of said drive bar are residing in operative contact with the notches of the strainer base.

14. The wrench as recited in claim 12 in which said depth limiting means is a member rigidly attached to said shaft, said member being dimensioned to come firmly to rest in the throat of the strainer base at such time as the ends of said drive bar are residing in operative contact with the notches of the strainer base.

15. The wrench as recited in claim 12 in which said depth limiting means is circularly shaped.

16. The wrench as recited in claim 12 in which said depth limiting means for engaging the throat of the strainer base is multi-sided.

17. The wrench as recited in claim 12 in which said handle forms a T-shaped relationship to said shaft.

* * * * *